US010555381B2

(12) United States Patent
Chappell et al.

(10) Patent No.: US 10,555,381 B2
(45) Date of Patent: Feb. 4, 2020

(54) INDUCTION HOB

(71) Applicant: Electrolux Appliances Aktiebolag, Stockholm (SE)

(72) Inventors: Lee Chappell, Springfield, TN (US); Harald Hoffmann, Rothenburg ob der Tauber (DE); Alex Viroli, Forli (IT); Laurent Jeanneteau, Forli (IT); Andrea Fattorini, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 350 days.

(21) Appl. No.: 15/521,639

(22) PCT Filed: Nov. 26, 2015

(86) PCT No.: PCT/EP2015/077730
§ 371 (c)(1),
(2) Date: Apr. 25, 2017

(87) PCT Pub. No.: WO2016/087297
PCT Pub. Date: Jun. 9, 2016

(65) Prior Publication Data

US 2017/0238375 A1 Aug. 17, 2017

(30) Foreign Application Priority Data

Dec. 3, 2014 (EP) ..... 14195991

(51) Int. Cl.
*H05B 6/12* (2006.01)

(52) U.S. Cl.
CPC ..... *H05B 6/1263* (2013.01); *H05B 6/1272* (2013.01); *H05B 2206/022* (2013.01); *H05B 2213/03* (2013.01)

(58) Field of Classification Search
CPC .. H05B 6/1209; H05B 6/1218; H05B 6/1236; H05B 6/1245; H05B 6/1254;
(Continued)

(56) References Cited

U.S. PATENT DOCUMENTS

2010/0219179 A1* 9/2010 Lin ..... F24C 15/101 219/623
2012/0152933 A1* 6/2012 Matsui ..... H05B 6/1263 219/623
(Continued)

FOREIGN PATENT DOCUMENTS

DE 4339877 A1 5/1995
DE 102010028549 A1 11/2010
(Continued)

OTHER PUBLICATIONS

International Search Report and Written Opinion issued in corresponding application No. PCT/EP2015/077730 dated Feb. 18, 2016, 10 pages.

*Primary Examiner* — Hung D Nguyen
(74) *Attorney, Agent, or Firm* — Pearne & Gordon LLP

(57) ABSTRACT

An induction hob including at least one switching element and at least one induction coil is provided. The switching element provides an alternating current flow through the induction coil. Cooling means provide airflow through the induction hob for cooling the switching element and the induction coil. The induction coil is arranged at a first side of a first plate-shaped support element and the switching element is arranged at a first side of a second plate-shaped support element. The first support element and the second support element are connected to one another and are arranged at a distance in order to form an air channel therebetween. The cooling means are arranged such that airflow is provided through the air channel.

16 Claims, 3 Drawing Sheets

(58) Field of Classification Search
CPC ..... H05B 6/1263; H05B 6/1272; H05B 2206/022; H05B 2213/03
USPC ..... 219/620, 622, 623, 624, 627, 632, 219/660–663, 667, 671, 672, 675–677
See application file for complete search history.

(56) References Cited

U.S. PATENT DOCUMENTS

| | | | | |
|---|---|---|---|---|
| 2015/0013660 | A1* | 1/2015 | Holzinger ..... | H05B 6/1209 219/460.1 |
| 2015/0114953 | A1 | 4/2015 | Suzuki et al. | |

FOREIGN PATENT DOCUMENTS

| | | | |
|---|---|---|---|
| EP | 2427032 | A2 | 3/2012 |
| EP | 2595450 | A2 | 5/2013 |
| EP | 2648478 | A1 | 10/2013 |
| WO | 2014156010 | A1 | 10/2014 |

* cited by examiner

INDUCTION HOB

The present invention relates generally to the field of induction hobs. More specifically, the present invention is related to an induction hob with an induction hob module showing enhanced cooling properties.

BACKGROUND OF THE INVENTION

Induction hobs for preparing food are well known in prior art. Induction hobs typically comprise at least one heating zone which is associated with at least one induction element. For heating a piece of cookware placed on the heating zone, the induction element is coupled with electronic driving means for driving an AC current through the induction element. Said AC current generates a time varying magnetic field. Due to the inductive coupling between the induction element and the piece of cookware placed above the induction element, the magnetic field generated by the induction element causes eddy currents circulating in the piece of cookware. The presence of said eddy currents generates heat within the piece of cookware due to the electrical resistance of said piece of cookware.

When operating an induction hob, heat is emitted by the induction coils and the switching elements. In order to avoid an overheating of said components, cooling means, e.g. fans, may be used in order to remove said heat.

German Patent Application DE 43 39 877 A1 discloses an induction hob comprising induction heaters and switching means of said induction heaters. The induction hob comprises a fan for providing an air flow through the induction hob for cooling said induction heaters and said switching means.

SUMMARY OF THE INVENTION

It is an objective of the embodiments of the invention to provide an induction hob with an effective and installation space-saving cooling arrangement for cooling the at least one induction coil and the at least one switching module. The objective is solved by the features of the independent claims. Preferred embodiments are given in the dependent claims. If not explicitly indicated otherwise, embodiments of the invention can be freely combined with each other.

According to an aspect of the invention, the invention relates to an induction hob comprising at least one switching element and at least one induction coil. The switching element is electrically coupled with said induction coil for providing an alternating current flow through said induction coil. The induction hob further comprises cooling means providing an airflow through the induction hob for cooling said switching element and said induction coil. The induction coil is arranged at a first side of a first plate-shaped support element and the switching element is arranged at a first side of a second plate-shaped support element. In addition, the first support element and the second support element are connected to one another and arranged at a distance in order to form an air channel between the first and second support element. The cooling means are arranged such that an airflow is provided through said air channel. Thereby an efficient and reliable cooling of said induction coil and said switching element with reduced installation space requirements is achieved.

According to preferred embodiments, the induction hob comprises a plurality of switching elements and a plurality of induction coils, wherein said plurality of induction coils is arranged at said first side of said first plate-shaped support element and said plurality of switching elements is arranged at said first side of said second support element. Thereby a space-saving arrangement of the switching elements and the induction coils at the support elements providing said cooling is achieved.

According to preferred embodiments, the first and second plate-shaped support elements are made of a material comprising thermal conductivity greater than 200 W/(m*K), specifically made of aluminium, copper, or a metal alloy comprising aluminium or copper. Thus, the heat emitted by the induction coil and the switching element travels through the respective support element towards the air channel and is thereby removed by the air flow provided by the cooling means.

According to preferred embodiments, the first plate-shaped support element comprises a second side being arranged opposite to the first side of said first support element, wherein said second side faces the second plate-shaped support element. In other words, the side of the first support element which does not bear the induction coils is arranged adjacent to the second support element, wherein said second side laterally confines the air channel.

According to preferred embodiments, the second plate-shaped support element comprises a second side being arranged opposite to the first side of said second support element, wherein said second side faces the first plate-shaped support element. In other words, the side of the second support element which does not bear the switching elements is arranged adjacent to the first support element, wherein said second side laterally confines the air channel.

According to preferred embodiments, the first and the second support element form a sandwich-like plate arrangement, wherein the at least one switching element and the at least one induction coil are arranged at opposite sides of said sandwich-like plate arrangement. Thereby, the air channel can be formed through the sandwich-like plate arrangement, i.e. between the first and the second support element in order to cool the components arranged at both sides of the plate arrangement.

According to preferred embodiments, the distance between the first and the second support element is between 10 mm and 20 mm, specifically 12 mm, 14 mm, 16 mm or 18 mm. Therefore, also the air channel has a width according to the upper-mentioned dimensions.

An air channel with such dimensions may allow a well-confined air flow with a limited height of the induction hob module comprising the plate arrangement, the induction coil and the switching element.

According to preferred embodiments, the at least one induction coil is in thermally conductive contact with the first side of the first support element and the at least one switching element is in thermally conductive contact with the first side of the second support element. Thus, the heat provided by the induction coil is transferred to the first support element and the heat provided by the switching element is transferred to the second support element in order to be removed by the air flowing through the air channel confined by said support elements.

According to preferred embodiments, the at least one induction coil is glued to the first side of the first support element. For example, a thermally conductive adhesive may be used in order to enable a good heat transfer to the first support element.

According to preferred embodiments, the at least one switching element is included in an electronic power module powering the induction coil and said power module is mounted on the first side of the second support element using Insulated Metal Substrate (IMS) technology. More in detail, on top of the first side of the second support element there may be a dielectric layer, said dielectric layer comprising a copper layer opposite to the second support element. The copper layer is used for providing an electrical contact to the switching element. Said mounting by means of IMS technology is advantageous because the heat transfer between the switching element and the second support element is enhanced.

According to preferred embodiments, one of said plate-shaped support elements laterally protrudes beyond the other plate-shaped support element, wherein said protrusion is used for deflecting the air flow provided by said cooling means. For example, the air flow is directed upwardly and deflected at the first support element forming the upper support element thereby redirecting the air flow into the longitudinal direction of the air channel. Thus, an effective and space-saving routing of air through the air channel is achieved.

According to preferred embodiments, the cooling means are adapted to provide an air flow in a flow direction and said flow direction is inclined relative to the longitudinal direction of the air channel by an angle $\alpha$, wherein $\alpha$ is between 25° and 45°. Preferably, the angle $\alpha$=30°, $\alpha$=35° or $\alpha$=40°.

According to a further aspect, the invention relates to a method for cooling at least one switching element and at least one induction coil of an induction hob by cooling means providing an airflow through the induction hob, the method comprising the steps of:

- providing a first plate-shaped support element, the induction coil being arranged at a first side of said first plate-shaped support element;
- providing a second plate-shaped support element, the switching element being arranged at a first side of said second plate-shaped support element, wherein the first support element and the second support element are connected to one another and arranged at a distance in order to form an air channel between the first and second support element;
- providing an airflow through said air channel for cooling said switching element and said induction coil by removing heat from the first and second support element.

The term "essentially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
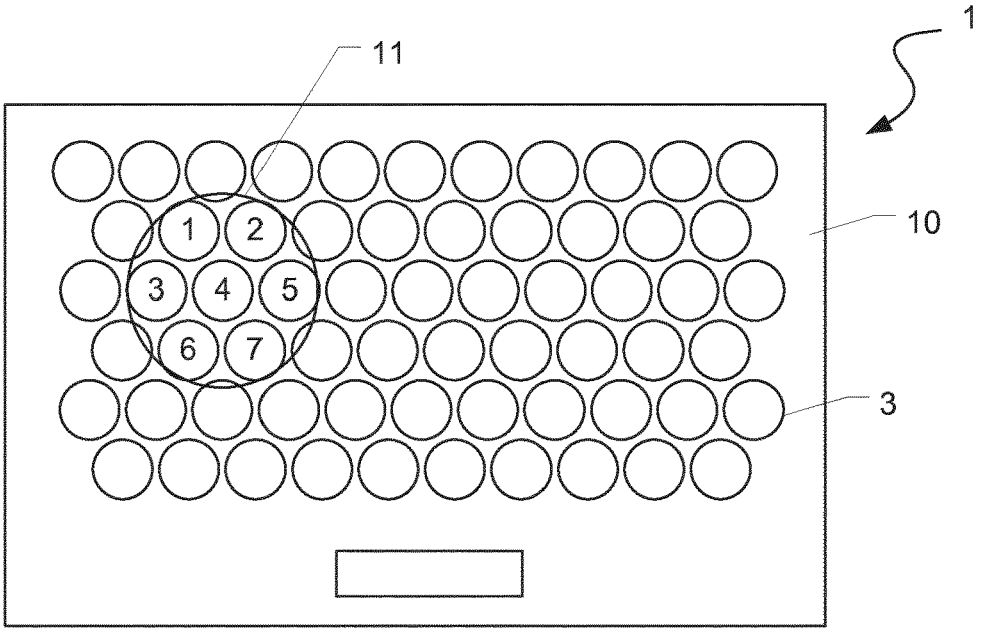
FIG. 1 shows a schematic view of an induction hob according to the current invention.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows an induction hob 1 according to an embodiment. The induction hob 1 comprises a cooking surface 10, e.g. a glass ceramic plate and a plurality of hob induction coils 3 which are placed beneath the cooking surface 10. The hob induction coils 3 may be arranged in a matrix-like manner. The hob induction coils 3 form heating elements being adapted to heat a piece of cookware 11 placed on the cooking surface 10 by induction heating.

Figure 2:
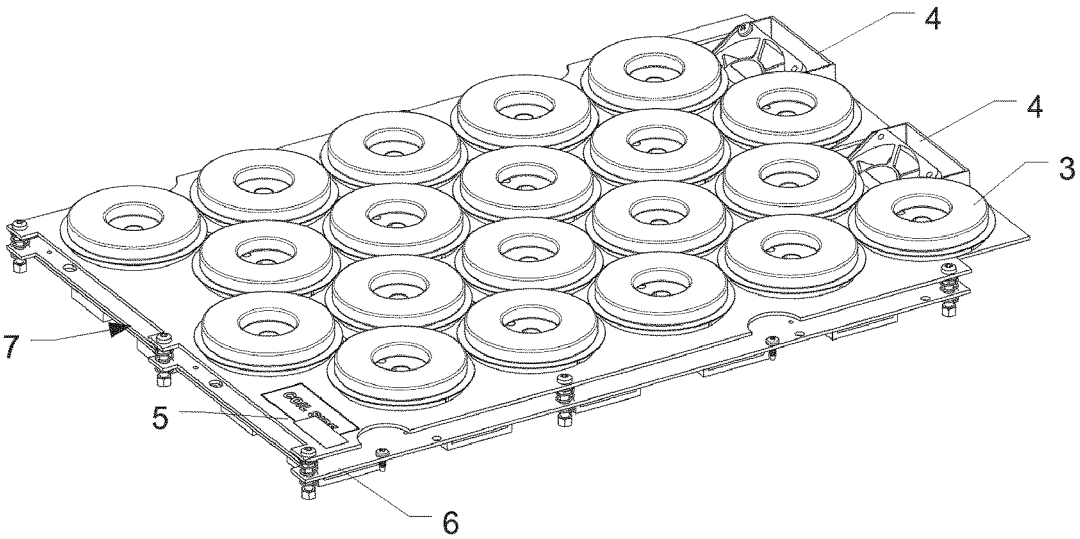
FIG. 2 shows an example induction hob module comprising a plate arrangement with a plurality of induction coils and a plurality of switching elements in a perspective top view.
Figure 3:
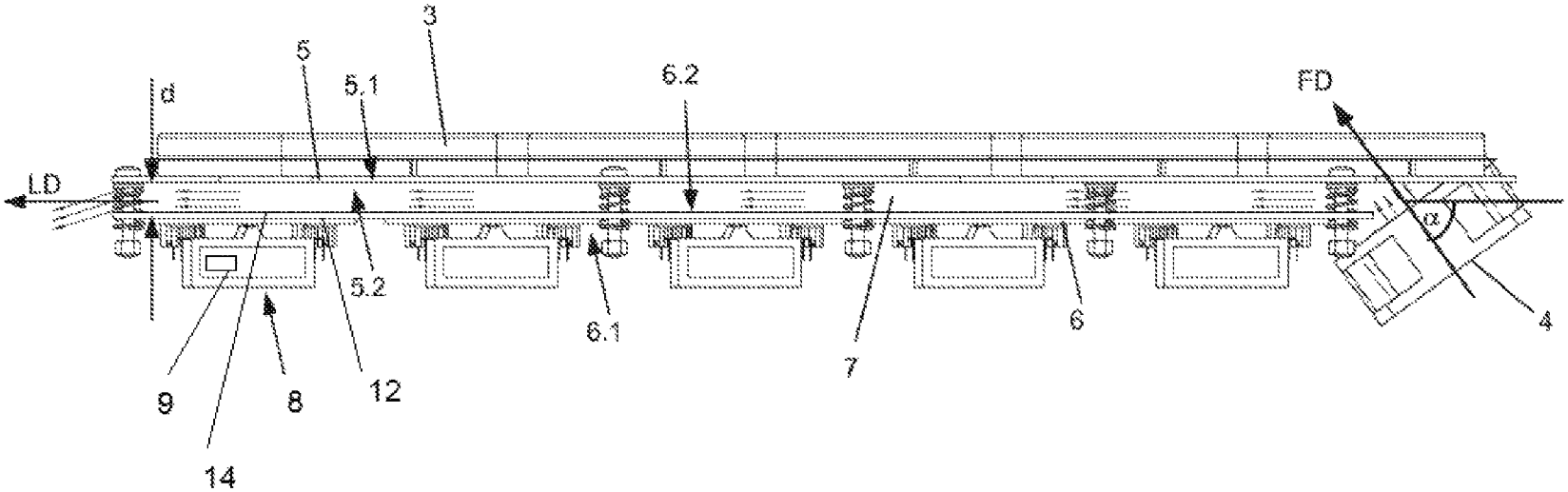
FIG. 3 shows an example induction hob module comprising a plate arrangement with a plurality of induction coils and a plurality of switching elements in a side view.
Figure 4:
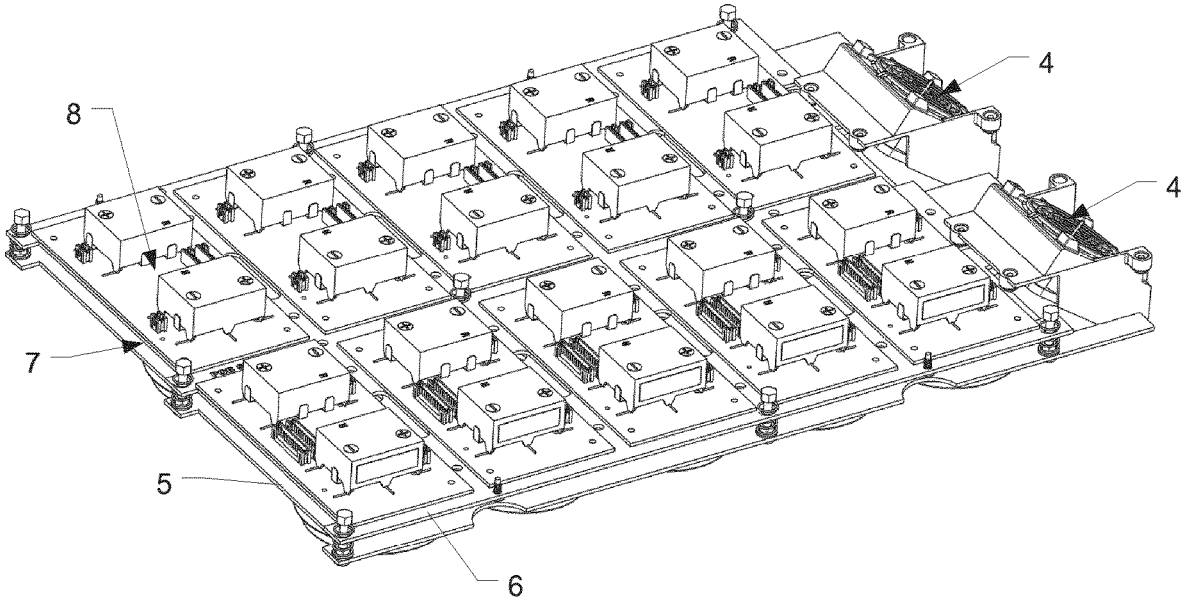
FIG. 4 shows an example induction hob module comprising a plate arrangement with a plurality of induction coils and a plurality of switching elements in a perspective rear view.

FIGS. 2 to 4 show an arrangement of a plurality of induction coils 3 and a plurality of electronic power modules 8 which are mounted at a sandwich-like plate arrangement. The electronic power modules 8 are adapted to provide electric power to the induction coils 3. Specifically, each electronic power module 8 comprises at least one switching element 9 for providing an alternating current through a respective induction coil 3. The switching element 9 may be, for example, an insulated-gate bipolar transistor (IGBT).

The plate arrangement comprises at least a first and a second plate-shaped support element 5, 6. Said support elements 5, 6 may be formed by a sheet material, specifically a planar sheet material. The plate-shaped support elements 5, 6 are connected to one another by interconnecting means. Said interconnecting means may be, for example, studs or bolts. By means of said interconnecting means, said support elements 5, 6 are arranged at a distance d to one another. Said distance may be in the range between 10 mm and 20 mm, for example 11 mm, 12 mm, 13 mm, 14 mm, 15 mm, 16 mm, 17 mm, 18 mm or 19 mm.

The induction coils 3 may be arranged at a first side 5.1 of the first support element 5. For example, the induction coils 3 may be arranged in rows, wherein the induction coils 3 of consecutive rows are offset by half the distance of consecutive induction coils 3. The induction coils 3 may be attached to the first side 5.1 of the first support element 5 such that a high thermal conductivity is achieved. For example, the induction coils 3 may be glued to the first side 5.1 of the first support element 5.

The electronic power modules 8 including the switching elements 9 may be arranged at a first side 6.1 of the second support element 6. Regarding the sandwich-like plate arrangement, the first side 6.1 of the second support element 6 may be arranged opposite to the first side 5.1 of the first support element 5. In other words, the switching elements 9 and the induction coils 3 may be arranged at opposite sides of the sandwich-like plate arrangement.

For example, the electronic power modules 8 may be mounted on the first surface 6.1 of the second support element 6 using Insulated Metal Substrate (IMS) technology. The second support element 6 forms the baseplate of the IMS structure which is covered by a dielectric layer 12. The dielectric layer 12 is covered by a copper layer 14 providing the electrical connectivity to the switching element 9.

Due to the distance d between the first and second support element 5, 6 and the plate-like shape of the first and second support element 5, 6, an air channel 7 is formed between the first and second support element 5, 6. More in detail, the second sides 5.2, 6.2 of the first and second support element 5, 6 laterally confine an air channel 7 through which heat emitted by the switching elements 9 and the induction coils 3 may be removed by the provision of an air flow. Preferably, said second sides 5.2, 6.2 of the first and second support element 5, 6 do not or essentially not comprise any components or devices which may impede the air flow through the air channel 7.

In order to enable an effective heat transfer to the second sides 5.2, 6.2 of the first and second support element 5, 6, i.e. the sides confining the air channel 7, the support elements 5, 6 may be formed out of a material comprising a high thermal conductivity, for example a thermal conductivity greater than 200 W/(m*K). Preferably, the support elements 5, 6 may be made of aluminium, copper, or a metal alloy comprising aluminium or copper.

For providing an air flow through the air channel 7 in order to remove heat provided by the switching elements 9 and the induction coils 3, cooling means 4 are arranged at the plate arrangement. Said cooling means 4 may comprise one or more fans, for example, axial, radial or tangential fans. Said cooling means 4 may provide an air flow in a flow direction FD, wherein said flow direction FD is inclined relative to the longitudinal direction LD of the air channel 7 by an angle α. Said angle α may be in the range between 25° and 45°, preferably 30°, 35° or 40° and may open in a direction opposite to the plate arrangement.

The air flow provided by the cooling means 4 may be deflected by one of said support elements 5, 6 and thereby guided into the air channel 7.

Preferably, the cooling means 4 may be adapted to provide an upwardly directed air flow which is deflected by the first support element 5 forming the upper support element of said support element arrangement. For example, the first support element 5 may laterally protrude beyond the second support element 6 and the cooling means 4 may be adapted to provide an air flow towards the second side 5.2 of the first support element 5. By means of said first support element 5, the air flow is redirected into the longitudinal direction LD of the air channel 7.

By means of upper-mentioned plate arrangement comprising the induction coils 3 and the switching elements 9, an effective cooling of said induction coils 3 and said switching elements 9 is achieved paired with a compact design thereby reducing the necessary installation space.

It should be noted that the description and drawings merely illustrate the principles of the proposed methods and systems.

Those skilled in the art will be able to implement various arrangements that, although not explicitly described or shown herein, embody the principles of the invention.

LIST OF REFERENCE NUMERALS 1 induction hob
3 induction coil
4 cooling means
5 first support element
5.1 first side
5.2 second side
6 second support element
6.1 first side
6.2 second side
7 air channel
8 electronic power module
9 switching element
10 cooking surface
11 piece of cookware
12 dielectric layer
14 copper layer
α angle
d distance
FD flow direction
LD longitudinal direction

The invention claimed is:

1. An induction hob comprising at least one switching element and at least one induction coil, the switching element providing an alternating current flow through said induction coil and cooling means providing an airflow through the induction hob for cooling said switching element and said induction coil, wherein the induction coil is arranged at a first side of a first plate-shaped support element and the switching element is arranged at a first side of a second plate-shaped support element, wherein the first plate-shaped support element and the second plate-shaped support element are connected to one another and arranged at a distance in order to form an air channel between the first and second plate-shaped support elements, wherein the air channel is formed between a second side of the first plate-shaped support element and a second side of the second plate-shaped support element, said second sides of the first and second plate-shaped support elements being arranged respectively opposite the first sides of the respective first and second plate-shaped support elements, and wherein the cooling means are arranged such that an airflow is provided through said air channel.

2. The induction hob according to claim 1, said at least one switching element comprising a plurality of switching elements and said at least one induction coil comprising a plurality of induction coils, wherein said plurality of induction coils is arranged at said first side of said first plate-shaped support element and said plurality of switching elements is arranged at said first side of said second plate-shaped support element.

3. The induction hob according to claim 1, wherein the first and second plate-shaped support elements are made of a material comprising thermal conductivity greater than 200 W/(m*K), said material being selected from the group consisting of aluminum, copper and metal alloys thereof.

4. The induction hob according to claim 1, wherein the distance between the first and the second plate-shaped support elements is between 10 mm and 20 mm.

5. The induction hob according to claim 4, said distance being 12 mm, 14 mm, 16 mm or 18 mm.

6. The induction hob according to claim 1, wherein the at least one induction coil is in thermally conductive contact with the first side of the first plate-shaped support element and the at least one switching element is in thermally conductive contact with the first side of the second plate-shaped support element.

7. The induction hob according to claim 1, wherein the at least one induction coil is glued to the first side of the first plate-shaped support element.

8. The induction hob according to claim 1, wherein the at least one switching element is included in an electronic power module powering the induction coil and said power module is mounted on the first side of the second plate-shaped support element using Insulated Metal Substrate (IMS) technology.

9. The induction hob according to claim 1, wherein one of said plate-shaped support elements laterally protrudes beyond the other plate-shaped support element, wherein said protrusion is used for deflecting the air flow provided by said cooling means.

10. The induction hob according to claim 1, wherein the cooling means are adapted to provide an air flow in a flow direction that is inclined relative to the longitudinal direction of the air channel by an angle $\alpha$, wherein $\alpha$ is between 25° and 45°.

11. The induction hob according to claim 1, wherein the first sides of the first and second plate-shaped support elements face away from each other.

12. The induction hob according to claim 1, wherein the first and second plate-shaped support elements each comprise a second side, and the air channel is formed between the second sides of the first and second plate-shaped support elements.

13. A method for cooling at least one switching element and at least one induction coil of an induction hob by cooling means providing an airflow through the induction hob, the method comprising the steps of:

providing a first plate-shaped support element, the at least one induction coil being arranged at a first side of said first plate-shaped support element;

providing a second plate-shaped support element, the at least one switching element being arranged at a first side of said second plate-shaped support element, wherein the first plate-shaped support element and the second plate-shaped support element are connected to one another and arranged at a distance in order to form an air channel between the first and second plate-shaped support element, and wherein the air channel is formed between a second side of the first plate-shaped support element and a second side of the second plate-shaped support element, said second sides of the first and second plate-shaped support elements being arranged respectively opposite the first sides of the respective first and second plate-shaped support elements;

providing an airflow through said air channel for cooling said at least one switching element and said at least one induction coil by removing heat from the first and second plate-shaped support elements.

14. An induction hob comprising a first, thermally conductive plate-shaped support element and a second, thermally conductive plate-shaped support element connected to and arranged at a distance from one another to form an air channel between an inner faces of the first plate-shaped support element and an inner face of the second plate-shaped support element, an induction coil mounted to and in thermally conductive contact with an outer face of the first plate-shaped support element opposite the inner face thereof, a switching element mounted to and in thermally conductive contact with an outer face of the second plate-shaped support element opposite the inner face thereof, a fan arranged to direct a flow of air along a flow direction toward, and at an angle, $\alpha$, relative to, the inner surface of one of said first and second plate-shaped support elements, so that said flow of air will be deflected into said air channel to draw heat generated from said induction coil and from said switching element, respectively, from the first and second plate-shaped support elements, each of said first and second plate-shaped support elements having a thermal conductivity of at least 200 W/(m*K).

15. The induction hob of claim 14, said induction coil being glued to the outer face of said first plate-shaped support element via a thermally conductive adhesive, said switching element being mounted to the outer face of said second plate-shaped support element via an Insulated Metal Substrate (IMS) arrangement wherein said second plate-shaped support element forms a baseplate of said IMS arrangement and is covered by a dielectric layer, wherein a copper layer covers said dielectric layer and provides electrical connectivity to the switching element.

16. The induction hob of claim 14, said inner faces of both said first and second plate-shaped support elements being devoid of components that will impede said flow of air from flowing through said air channel.

* * * * *